United States Patent [19]

Wolters

[11] 4,062,587

[45] Dec. 13, 1977

[54] BACK POSITION CONTROL DEVICE FOR CHAIRS

[75] Inventor: Richard H. Wolters, Grand Rapids, Mich.

[73] Assignee: Herman Miller, Inc., Zeeland, Mich.

[21] Appl. No.: 648,794

[22] Filed: Jan. 13, 1976

[51] Int. Cl.[2] ..... A47C 7/027

[52] U.S. Cl. ..... 297/306; 297/374

[58] Field of Search ..... 297/300, 304–306, 297/326, 354, 355, 373, 374; 403/111; 248/293; 16/140, 180

[56] References Cited

U.S. PATENT DOCUMENTS

| | | | |
|---|---|---|---|
| 800,669 | 10/1905 | Nowland | 297/374 |
| 877,274 | 1/1908 | Weber | 297/411 |
| 1,336,510 | 4/1920 | Collier | 297/374 X |
| 1,654,787 | 1/1928 | Case | 16/140 |
| 1,856,534 | 5/1932 | Boery | 297/373 |
| 2,650,644 | 9/1953 | Malco | 297/374 X |
| 2,660,226 | 11/1953 | Wing | 297/373 |
| 2,844,193 | 7/1958 | Lauterbach | 297/116 |
| 2,980,170 | 4/1961 | Bechtold | 297/374 X |
| 3,135,549 | 6/1964 | Larsson | 297/326 X |
| 3,216,766 | 11/1965 | Tabor | 297/374 |
| 3,423,785 | 1/1969 | Pickles | 16/140 |
| 3,515,433 | 6/1970 | Tabor | 297/374 |
| 3,801,155 | 4/1974 | Hodgen et al. | 297/374 |
| 3,837,705 | 9/1974 | Marraccini | 297/374 X |

FOREIGN PATENT DOCUMENTS

| | | | |
|---|---|---|---|
| 1,755,102 | 7/1971 | Germany | 297/355 |
| 916,263 | 8/1954 | Germany | 297/374 |
| 1,654,288 | 3/1971 | Germany | 297/304 |
| 401,718 | 11/1933 | United Kingdom | 297/374 |

*Primary Examiner*—Roy D. Frazier
*Assistant Examiner*—William E. Lyddane
*Attorney, Agent, or Firm*—Price, Heneveld, Huizenga & Cooper

[57] ABSTRACT

A pivotally mounted back support for a chair is disclosed incorporating a pivotal mounting utilizing a plurality of interleaved clutch plates. Alternate ones of the clutch plates are stationary and the remainder are connected to the lower end of the back support post to pivot with the post about a common pivot shaft. Locking of the fore and aft pivotal position of the back is effected by squeezing together the clutch plates to provide a surface-to-surface frictional bond. Springs urge the post into erected position. A handle, readily accessible to a person seated on the chair is provided to effect locking and release of the clutch and thus pivotal adjustment of the position of the back.

15 Claims, 9 Drawing Figures

BACK POSITION CONTROL DEVICE FOR CHAIRS

BACKGROUND OF THE INVENTION

It is important in many types of seating, especially the types of seating used in commercial and professional operations such as by typists, computer operators, draftsman and the like that the position of the back be capable of accurate and precise adjustment. It is known that seating that does not provide effective, adequate and comfortable body support results in premature fatigue as well as physical discomfort. If the condition prevails over a long period of time, it may result in physical disabilities of one type or another on the part of the user.

While adjustable back mechanisms and supports have been known for a long time, these mechanisms have been subject to one or more of various types of shortcomings. Among the major of these shortcomings has been the fact that many mechanisms are subject to failure should the user suddenly lean backward, imposing a shock load on the hinge of the pivot joint about which the back is adjusted. Another shortcoming in the case of many of the known adjustable back supports is that they are capable of providing only a limited number of adjusted positions and, thus, are not necessarily capable of positioning the back in the most effective position for the particular operator or the particular operation which the operator is conducting while utilizing the seating.

In satisfying the requirements of both infinite adjustment and a structure which is dependable, it is important to consider that the pivot joint about which the back is made adjustable is subject to very heavy loads, even under normal operating conditions. It is also subject to severe shock loading as well as frequent abuse. It is thus important to provide a hinge or pivot joint which can sustain this type of usage over a long period of time. It must also be a joint which once locked in a particular position will retain this position under all normally expected operating conditions including those which impose severe forces tending to shift the back from its selected positions. It is important that the joint resist the tendency to crimp under repeated impact of a user sitting back in the seat.

Other desirable criteria is providing a pivoted back support for a chair and that it be compact and that it have a neat and attractive appearance.

SUMMARY OF THE INVENTION

A clutch type mechanism is provided which mounts the back supporting post on a pivot shaft together with a member of interleaved clutched plates. The post and alternative ones of the clutch plates are connected to springs which bias the post into erected position. The remaining clutch plates are positively held against rotation about the pivot shaft and act as braking surfaces when the clutch plates are squeezed together. A handle is provided by which the operator can either squeeze clutch plates into tightly clamped position locking the back supporting post in a selected position or alternately releasing the clamping pressure from the clutch plates, permitting the back supporting post to pivot about the pivot pin. Springs bias the back support into erected position.

DESCRIPTION OF THE PREFERRED EMBODIMENT

Figure 2:
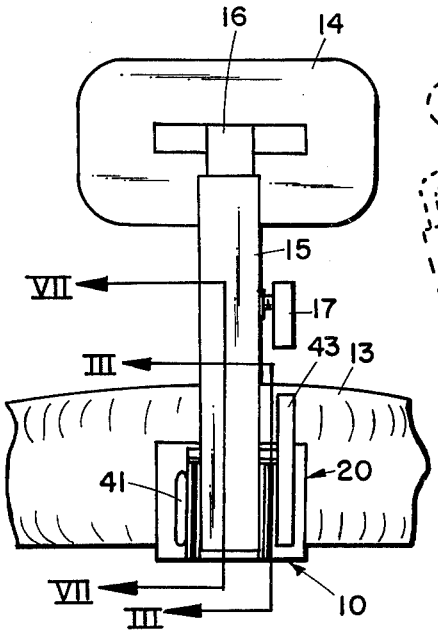
FIG. 2 is a fragmentary rear view of the chair seat and back illustrated in FIG. 1.
Figure 1:
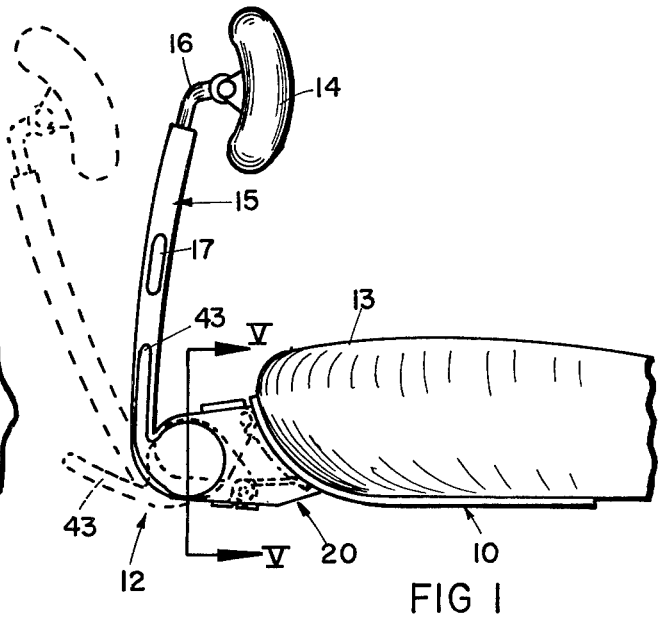
FIG. 1 is a fragmentary, side elevation view of a chair seat and back equipped with this invention.

Referring to FIG. 1, the numeral 10 identifies a seat frame to which a back support 11 is pivotally attached at 12. The seat frame 10 mounts a cushion 13 and a back cushion 14 is provided at the top of the back support. No standard or leg support for the seat frame is shown since it forms no part of this invention and can be of any conventional construction. The lower portion of the back support 11 is a tubular post 15 which receives the extension bracket 16, the upper end of which mounts the back cushion 14. The vertical position of the extension bracket is adjustable and its position is locked by the lever 17.

Figure 6:
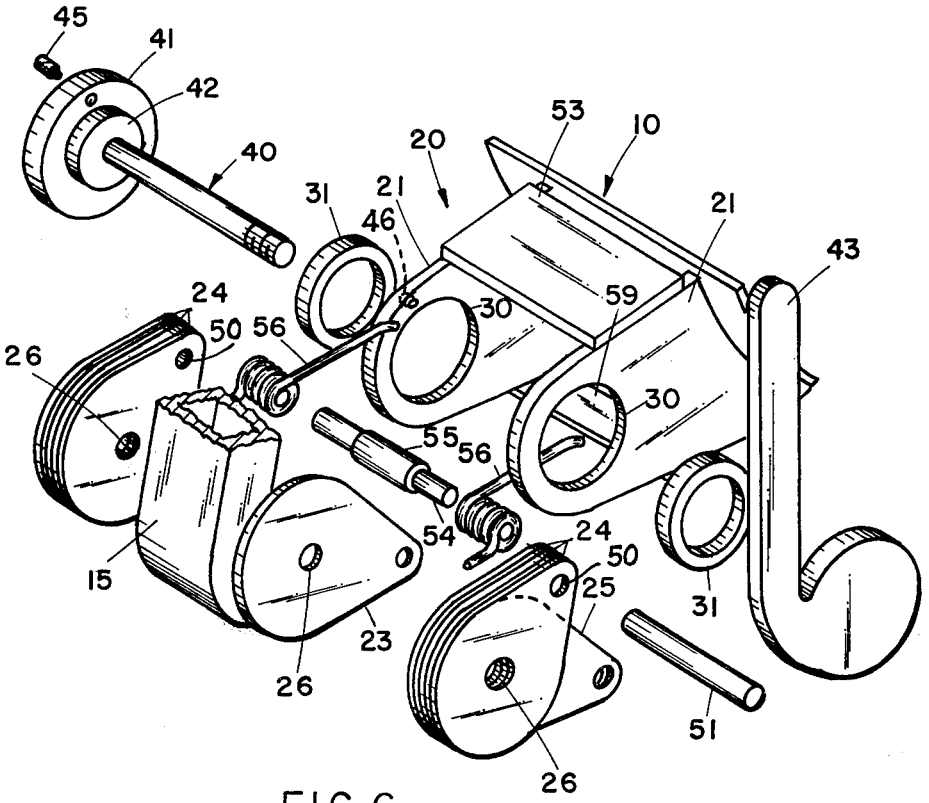
FIG. 6 is an exploded, oblique view of the clutch mechanism of this invention.

The rear portion of the seat frame 10 is curved upwardly and a trunnion bracket 20 is mounted to it and extends rearwardly (FIG. 6). The trunnion bracket has a pair of spaced, parallel, rearwardly extending side pieces 21 rigidly secured at their forward ends, as by welding, to the rear face of the seat frame 10.

Figure 4:
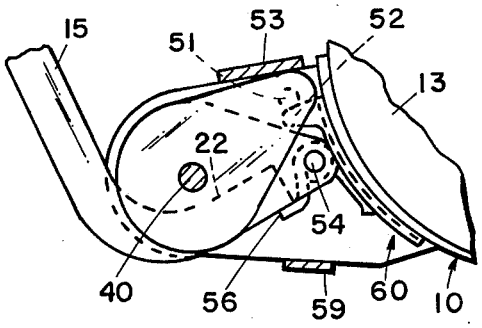
FIG. 4 is a fragmentary sectional view taken along the same plane as FIG. 3, showing the back support in the rearwardly adjusted position.
Figure 3:
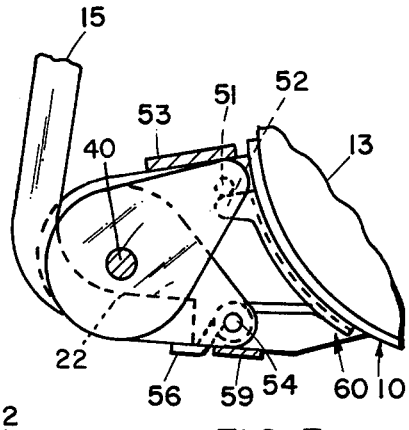
FIG. 3 is a fragmentary sectional view taken along the plane III—III of FIG. 2, showing the back support in the erected position.
Figure 5:
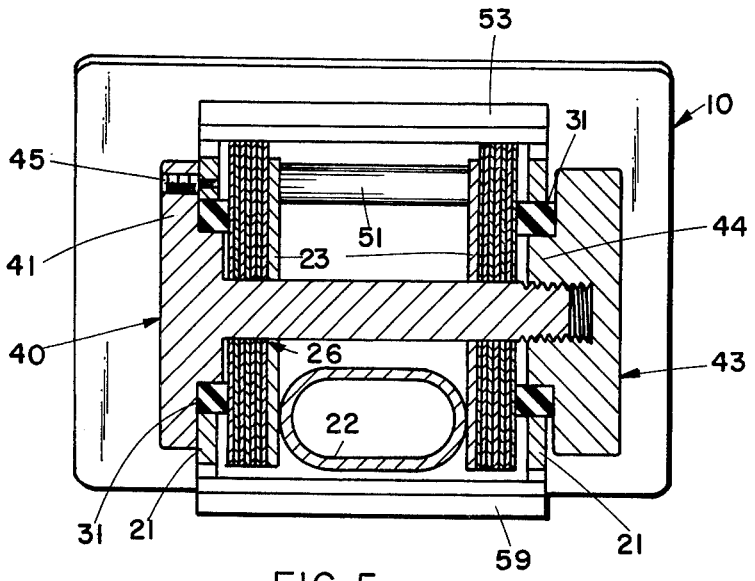
FIG. 5 is an enlarged sectional view taken along the plane V—V of FIG. 1.

The lower end of the post 15 is curved forwardly to provide a forwardly extending foot portion 22 (FIGS. 3 and 4). A generally teardrop shaped wing plate 23 is welded to each side of the foot portion. The wing plates 23 project forwardly beyond the end of the foot portion. The wing plates 23 are spaced from both side pieces 21 of the trunnion bracket 20 and these spaces are occupied by clutch plates 24 and 25. The clutch plates 24 and 25 are identical in shape and size and like the wing plates, they are teardrop shaped. The clutch plates 24 are interleaved alternately between the clutch plates 25. At their larger ends, the clutch plates 24 and 25 and the wing plates 23 have an opening 26. The openings 26 collectively form the aperture to receive the shaft of the pivot bolt 40 (FIG. 5). The openings 26 are just inside the juncture of the vertical and foot portions of the post 15.

The openings 26 align concentrically with the aligned bearing openings 30 in the side plates 21. Seated within each of the bearing openings 30 is an annular bearing 31. The annular bearings 31 have an axial length greater than the thickness of the side plates 21 and, thus, extending inwardly of the side plates (FIG. 5). The pivot bolt 40 has a head 41 and a bearing shoulder 42. The bearing shoulder 42 is of a diameter to fit closely but rotatably with one of the annular bearings 31 to center the bolt within the bearing openings.

The other end of the pivot bolt is threaded and mounts a handle 43 (FIG. 5). The handle has a bearing shoulder 44 identical to the shoulder 42 to rotatably support and center the handle and pivot bolt in the bearing opening 30 of the adjacent side plate. The pivot bolt 40, passing through the openings 26 in the wing plates 23, provides the pivot for the back post 14 and, thus, the back post is supported by the trunnion bracket. The pivot bolt is held against rotation by the screw 45 (FIGS. 5 and 6). The screw 45 is threaded through the head 41 of the pivot bolt and has one end seated in the opening 46 in the adjacent side plate 21.

The small or forward ends of the clutch plates 24 have axially aligned holes 50, collectively forming an opening through which the anchor pin 51 is mounted. The anchor pin 51 at its central portion is supported on a stop finger 52 which projects rearwardly at the top of the hereinafter described track plate 60. The stop finger 52 prevents downward or clockwise rotation of the pin 51 and the clutch plates 24. The clutch plates 24 are held against upward or counterclockwise rotation by the stop plate 53 which spans the space between and is rigidly secured to, as by welding, the side plates 21. The stop plate 53 serves the further function of bracing the side plates 21.

Figure 7:
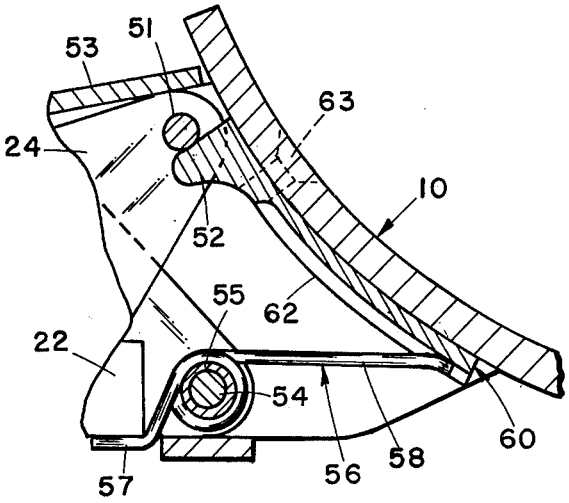
FIG. 7 is a fragmentary, enlarged, sectional view taken along the plane VII—VII of FIG. 2.
Figure 8:
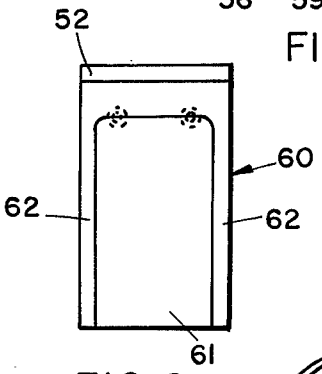
FIG. 8 is a rear elevational view of the spring track used in this invention.
Figure 9:
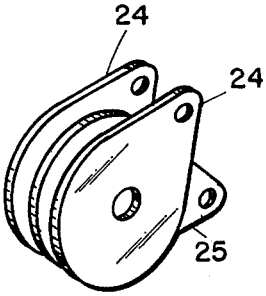
FIG. 9 is an oblique, exploded view of the interrelationship of the clutch plates.

The clutch plates 25 and the wing plated 23, at their small or forward ends, are also apertured to collectively receive the spring pin 54 (FIGS. 3, 4, 6 and 7). Between the wing plates 23 the spring pin is covered by a sleeve 55 (FIG. 6). Wrapped about the sleeve 55 are a pair of springs 56, each having one end 57 seated under the forward or foot portion 22 of the post 15 (FIGS. 3, 4 and 7). The opposite ends of the springs are formed by arms 58 which seat against the track plate 60. The track plate is contoured to seat against the rear face of the seat bracket 10 and has a central trackway 61 defined by a pair of spaced sides 62 (FIG. 8). The trackway terminates below the stop 52. The trackway is fabricated of a wear resistant material which will also silence the sound of the spring arms 58 as they slide vertically against the trackway. A suitable material for this purpose is a Nylon such as Nylon 6 or 66 sold by E. I. DuPont de Nemoirs Co. The track plate 60 is secured to the seat plate by any suitable means such as the screws 63.

The springs 56, acting on the pin 54 urge the forward end of the clutch plates 25 and the wing plates 23 downwardly. In so doing, the springs bias the post 15 into erected position, that is, the position shown in solid lines in FIG. 1. Downward movement of the springs and the clutch plates 25 is limited by the stop bar 59 which is attached to the side plates 21 as by welding (FIG. 7).

The clutch plates 24 and 25 are axially slidable along the pivot bolt 40. They are also fabricated of a material which has a relatively high coefficient of friction when the plates are in face-to-face contact. Steel is a material providing this characteristic.

Having described the structure in detail, the operation of the clutch mounting will be explained. Assuming the back is in erected and locked position, the operator first unlocks the clutch by rotating the handle 43 rearwardly to the position shown in phantom in FIG. 1. In so doing, the handle is rotated on the threads of the pivot bolt 40 in a manner to increase the spacing between the handle and the bolt head 41. Because of the set screw 45, the bolt cannot turn. The separation of the head and handle releases the clamping pressure between the clutch plates and the side plates. Once this engagement is released, the wing plates and the clutch plates 25 can pivot about the pivot bolt 40 permitting these plates to pivot upwardly with respect to the clutch plates 24. This rearward pivoting of the post 15 will not occur automatically because of the bias imposed by the springs. To adjust the position of the post 15, the operator pushes the post rearwardly to the desired position then rotates the handle 43 clockwise to lock the post in position.

The clockwise rotation of the handle 43 moves it toward the head 41 shifting the clutch plates 24 and 25 into tight frictional engagement. The wing plates 23, being tied to the clutch plates 25 by the spring pin 51 will be positively held by the frictional forces acting between the clutch plates 24 and 25.

As the handle 43 is rotated to lock the clutch, its inner surface presses against the bearing ring 31 forcing it inwardly against the clutch plates. At the other end of the pivot bolt, the other bearing ring 31 bears against the clutch plates, spacing them slightly from the adjacent side plate. Thus, the clamping forces created by the handle act by squeezing the clutch plates between the two bearing rings 31. It is immaterial that the bearing rings have only a limited area of contact with the clutch plates, since the application of squeezing pressure is their only function. The locking forces holding the post 15 result from frictional forces of face-to-face contact of the clutch plates. It is unimportant that the handle 43 be spaced from the adjacent side plate at all times so that all of its squeezing force is applied to the bearing ring 31.

As the post 15 is pivoted rearwardly, the wing plates 23, acting through the pin 51, force the center coils of the springs 56 upwardly (FIG. 4). This tightens the springs and causes the arm 58 to ride up the track 60. This is important because the springs preferably impose sufficient bias to return the post 15 to erected position automatically.

When the mechanism is locked rearwardly pivoting of the post 15 is prevented by the clutch plates 24. These plates cannot rotate counterclockwise, as the mechanism is illustrated in FIGS. 3 and 4, since they abut against the stop plate 53. Thus, the clutch type engagement between the plates and the bias of the springs 56 act cooperatively to prevent inadvertent backward pivoting of the back. This is an important safety feature.

The invention provides a strong and positive positioning mechanism for the back. It permits infinite adjustment within its design limits of operation. The mechanism is easily and quickly operated by the user while the chair is occupied requiring only that the operator manipulate the handle which is readily accessible. The invention provides a strong and durable attachment between the back and the seat frame. This is important because this structure is subject to heavy loads and often to abuse including wracking, twisting and shock loads. It also provides a mechanism which is compact and its operating mechanism is capable of being concealed to improve the aesthetics of the chair.

While a preferred embodiment of this invention has been illustrated and described, it will be recognized that modifications of the invention can be made. Such modifications which do not depart from the principles of the invention are to be considered as included in the hereinafter appended claims unless these claims by their language specifically state otherwise.

The embodiments of the invention in which as exclusive property or privilege is claimed are defined as follows:

1. In a chair having a seat supporting plate and a back supporting post, a manually operable clutch pivotally mounting said post to the rear portion of said plate, said clutch comprising: a trunnion having a pair of laterally spaced side members, said trunnion rigidly mounted to said plate and projecting rearwardly therefrom; said arms having a pair of aligned apertures; said post having a pair of elongated spaced wings rigidly secured to the lower end thereof received between said side members and extending forwardly at an acute angle to said post toward said plate; a shaft extending through said apertures and said wings adjacent the bottom of said post; means including annular bushings supporting said shaft in said apertures whereby it serves as the pivotal support for said post; spring means engaging the forward end of said wings and said plate and the lower end of said post forward of said shaft and pivotally urging said forward end of said wings downwardly and said post into forwardly erected position; at least one elongated clutch plate slidably mounted on said shaft between each of said wings and the adjacent one of said side members; means secured against movement with respect to said supporting plate and attached to each of said clutch plates and holding said clutch plates against rotation about said shaft; a handle mounted on one end and a stop mounted on the other end of said shaft, said handle being rotatable for changing the spacing between said stop and said handle for forcing said clutch plates into tight frictional engagement with said wings locking said post against pivotal movement.

2. The chair described in claim 1 wherein a first plurality of said clutch plates are provided adjacent each of said wings, a second plurality of clutch plates of similar construction adjacent each of said wings, said clutch plates of said second plurality being alternately positioned between the clutch plates of said first plurality; said spring means engaging the forward ends of said second plurality of clutch plates whereby said second plurality of clutch plates will rotate with said wings.

3. The chair described in claim 2 wherein a pin is provided, said pin engaging said spring means and all of said second plurality of clutch plates.

4. The chair described in claim 3 wherein said holding means is a pin attached to all of said first plurality of clutch plates and a pair of fixed stops, one engaging said pin and the other engaging said plates, said stops acting in opposite directions.

5. The chair described in claim 1 wherein means are provided for holding said shaft against rotation, said handle being threadedly mounted on said shaft.

6. In a chair having a seat supporting plate and a back supporting post, a manually operable clutch pivotally mounting said post to the rear portion of said plate, said clutch comprising: a trunnion having a pair of laterally spaced side members, said trunnion rigidly mounted to said plate and projecting rearwardly therefrom; said arms having a pair of aligned apertures; said post having a pair of elongated spaced wings rigidly secured to the lower end thereof received between said side members and extending at an acute angle to said post toward said plate; a shaft extending through said apertures and said wings adjacent the bottom of said post; means including annular bushings supporting said shaft in said apertures whereby it serves as the pivotal support for said post; spring means engaging the forward end of said wings and pivotally urging said post into forwardly erected position; a plurality of clutch plates mounted on said shaft between each of said wings and the adjacent one of said side members and axially slidable along said shaft; said clutch plates being divided into first and second groups with those of the first group being positioned alternately with respect to those of the second group; means holding the clutch plates of said first group against rotation about said shaft; means interconnecting said clutch plates of said second group to said wings for rotation therewith about said shaft; a handle mounted on one end and a stop mounted on the other end of said shaft, said handle being rotatable for changing the spacing between said stop and said handle for forcing said clutch plates into tight frictional engagement with each other and said wings locking said post against pivotal movement.

7. The chair as described in claim 6 wherein said interconnecting means is a pin secured to said forward end of said wings; said spring being wrapped around said pin and having one end engaging said post and the other end engaging said plate and urging said pin downwardly; a limit member on said trunnion for restricting the downward movement of said pin.

8. The chair described in claim 7 wherein a wear plate is mounted on the rear surface of said support plate, said wear plate having a central channel for slidably engaging said other end of said spring.

9. The chair described in claim 8 wherein said wear plate is of a plastic material to silence the movement of said spring.

10. The chair described in claim 8 wherein the upper end of said wear plate projects rearwardly and serves as that portion of said holding means resisting downward pivotal movement of said clutch plates of said one group of clutch plates.

11. The chair described in claim 10 wherein a bar is secured to said side members and serves as that portion of said holding means restricting upward pivotal movement of said clutch plates of said one group of clutch plates.

12. In a chair having a seat supporting plate and a back supporting post, means pivotally mounting said post to the rear portion of said plate, said means comprising: a trunnion having a pair of laterally spaced side members, said trunnion rigidly mounted to said plate and projecting rearwardly therefrom; the lower end of said post received between said side members and having a foot portion extending forwardly at an acute angle to said post toward said plate; a shaft pivotally mounting said post at a point adjacent the juncture of said post and foot portion to said side members; a pin at the forward end of said foot portion; spring means wrapped around said pin and having one end engaging the bottom of said foot portion and the other end engaging said plate and urging said pin downwardly and said post into erected position; a limit member on said trunnion for restricting the downward movement of said pins and foot portion, said spring being formed into an inverted V when said post is pivoted rearwardly; a handle element mounted on one end of said shaft and rotatable for forming a tight frictional lock between said foot portion and said side members.

13. A chair as described in claim 12 wherein a wear plate is mounted on the rear face of said plate; said wear plate having a rearwardly opening channel slidably receiving said other end of said spring; said wear plate being of a non-metallic, wear resistant material for silencing the operation of said spring.

14. In a chair having a seat supporting plate and a back supporting post, a manually operable clutch pivotally mounting said post to the rear portion of said plate, said clutch comprising: a trunnion having a pair of laterally spaced side members, said trunnion rigidly mounted to said plate and projecting rearwardly therefrom; said arms having a pair of aligned apertures; said post having a pair of elongated spaced wings rigidly secured to the lower end thereof received between said side members and extending forwardly at an acute angle to said post toward said plate; a non-rotatable shaft extending through said apertures and said wings adjacent the bottom of said post; means including annular bushings axially slidable along said shaft supporting said shaft in said apertures whereby said means serves as the pivotal support for said post; spring means having one end engaging said post and a second end engaging said plate, said spring means, intermediate the ends, engaging the forward end of said wings and pivotally urging said post into forwardly erected position; at least one clutch plate mounted on said shaft between each of said wings and the adjacent one of said side members; means holding said clutch plates against rotation about said shaft and axially movable along said shaft; a handle element threadably mounted on one end of said shaft for shifting said bushings axially of said shaft and forcing said clutch plates into tight frictional engagement with said wings when said handle element is rotated about said shaft.

15. In a chair having a seat frame and a back frame, said back frame having a post and means pivotably mounting said post to said seat frame, said means comprising: a pair of spaced trunnion plates mounted to said chair frame; a foot portion at the bottom of said post extending forwardly from said post, a pivot shaft mounted to said trunnion plates and secured to said post substantially at the junction of said post and foot portion; a first plurality of clutch plates mounted on said shaft and axially movable along the same; connector means securing said first clutch plates to said foot portion for rotation therewith about said shaft; spring means urging said foot portion and first clutch plates into forwardly and downwardly rotated position; a plurality of second clutch plates mounted on said shaft for axial sliding movement therealong interleaved alternately between said first clutch plates and means holding said second clutch plates against rotational movement about said shaft; clamping means for forcing said first and second clutch plates axially of said shaft into tight side face to side face engagement for locking said foot portion and post against rotation about said shaft.

* * * * *